US010828647B2

(12) United States Patent
Miettinen et al.

(10) Patent No.: US 10,828,647 B2
(45) Date of Patent: Nov. 10, 2020

(54) FROTH COLLECTION LAUNDER

(71) Applicant: OUTOTEC (FINLAND) OY, Espoo (FI)

(72) Inventors: Tatu Miettinen, Helsinki (FI); Rodrigo Grau, Pori (FI); Alejandro Yanez, Helsinki (FI); Zakaria Mönkäre, Helsinki (FI); Jere Tuominen, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 16/733,721

(22) Filed: Jan. 3, 2020

(65) Prior Publication Data

US 2020/0179948 A1 Jun. 11, 2020

Related U.S. Application Data

(63) Continuation of application No. PCT/FI2017/050503, filed on Jul. 4, 2017.

(51) Int. Cl.

| | |
|---|---|
| ***B03D 1/14*** | (2006.01) |
| ***B03D 1/08*** | (2006.01) |
| ***B03D 1/20*** | (2006.01) |

(52) U.S. Cl.

CPC ..... *B03D 1/1462* (2013.01); *B03D 1/082* (2013.01); *B03D 1/1418* (2013.01); *B03D 1/20* (2013.01)

(58) Field of Classification Search

CPC ..... B03D 1/1462

See application file for complete search history.

(56) References Cited

U.S. PATENT DOCUMENTS

2004/0031742 A1* 2/2004 Arnaud ..... B01D 21/2433 210/259
2008/0251427 A1* 10/2008 Mankosa ..... B03D 1/082 209/164
2016/0346791 A1* 12/2016 Forss ..... B01F 7/1645

FOREIGN PATENT DOCUMENTS

WO 9320945 A1 10/1993
WO 2009115348 A1 9/2009
WO WO-2009/115348 A1 * 9/2009 ..... B03D 1/14

OTHER PUBLICATIONS

International Search Report issued by the Finnish Patent and Registration Office acting as the International Searching Authority in relation to International Application No. PCT/FI2017/050503 dated Oct. 26, 2017 (4 pages).

(Continued)

*Primary Examiner* — Peter Keyworth

(74) *Attorney, Agent, or Firm* — Robert P. Michal, Esq.; Carter, DeLuca & Farrell LLP

(57) ABSTRACT

A froth collection launder for a collection of froth from a mineral flotation includes a first and a second sidewall which are joined to form a bottom including a tip extending along the bottom, the first sidewall including a first end and the second sidewall including a second end at their open ends, at least one of the first and the second ends includes a froth overflow lip, and when the froth collection launder is positioned at its operation position a centre line is located in the middle of the first and the second end in the cross direction (x) of the froth collection launder. The tip is located between the centre line and one of the first and the second end in the cross direction (x) of the froth collection launder and the tip forms the lowest point of the froth collection launder.

20 Claims, 4 Drawing Sheets

(56) References Cited

OTHER PUBLICATIONS

Written Opinion of the International Searching Authority issued by the Finnish Patent and Registration Office acting as the International Searching Authority in relation to International Application No. PCT/FI2017/050503 dated Oct. 26, 2017 (7 pages).

* cited by examiner

FROTH COLLECTION LAUNDER

CROSS-REFERENCE TO RELATED APPLICATIONS

This application is a continuation of International Application No. PCT/FI2017/050503 filed Jul. 4, 2017, the disclosure of this application is expressly incorporated herein by reference in its entirety.

FIELD OF THE INVENTION

The invention relates to a froth collection launder, and particularly to a froth collection launder balancing froth load to the froth collection launder.

BACKGROUND OF THE INVENTION

A froth flotation is used for treating mineral ore particles suspended in slurry. Air is bubbled through the slurry creating bubble-particle aggregates which move up in the froth flotation cell by buoyancy forming a froth layer on the surface. The froth from the formed froth layer is collected from the surface into a froth collection launder.

BRIEF DESCRIPTION OF THE INVENTION

An object of the present invention is to provide a froth collection launder that allows a better froth handling. The object of the invention is achieved by a froth collection launder which is characterized by what is stated in the independent claim. The preferred embodiments of the invention are disclosed in the dependent claims.

The invention is based on the idea of a froth collection launder for a collection of froth from a mineral flotation comprising a first and a second sidewall which are joined to form a bottom comprising a tip extending along the bottom. The first sidewall comprises a first end and the second sidewall comprises a second end at their open ends. At least one of the first and the second ends comprises a froth overflow lip. When the froth collection launder is positioned at its operation position a centre line is located in the middle of the first and the second end in the cross direction of the froth collection launder. The tip is located between the centre line and one of the first and the second end in the cross direction of the froth collection launder and the tip forms the lowest point of the froth collection launder.

The froth collection launder of the invention is advantageous in balancing the froth load to the froth collection launders. Further, as the froth collection launder effects on the froth flow direction the transport distance of the froth to the launder lip can be optimized.

BRIEF DESCRIPTION OF THE DRAWINGS

In the following the invention will be described in greater detail by means of preferred embodiments with reference to the accompanying drawings, in which.

DETAILED DESCRIPTION OF THE INVENTION

Figure 1:
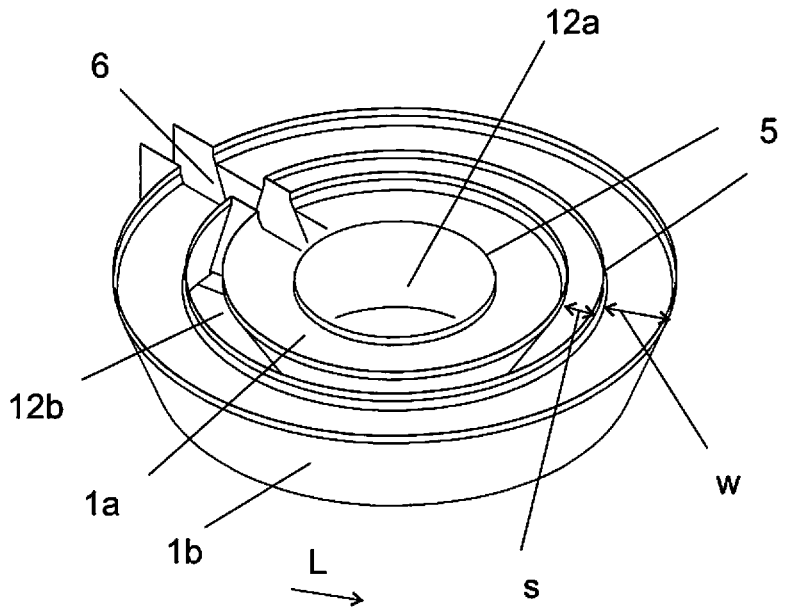
FIG. 1 shows a perspective view of two froth collection launders.

FIG. 1 shows a perspective view of two froth collection launders 1*a-b*. The froth collection launder 1*a-b* collects the froth from the surface and transports it out of the tank 2 of the froth flotation cell 3. The froth collection launder 1*a-b* is an inclined drainage module. The froth 4 layer level is generally above the froth overflow lip 5 of the launder 1*a-b* permitting the froth 4 to flow over the overflow lip 5. The froth collection launder 1*a-b* comprises a sub-surface discharge pipe 6 for carrying the collected froth 4, the overflow 18, from the launder 1*a-b* to outside of the tank 2, for instance.

FIG. 1 presents two froth collection launders 1*a-b*, and the first launder 1*a* is arranged within the second launder 1*b* at a distance s apart. The froth collection launders 1*a-b* comprise circular peripheries. In the FIG. 1 the shown froth collection launders 1*a*,1*b* comprise each one froth overflow lip 5.

Figure 2A:
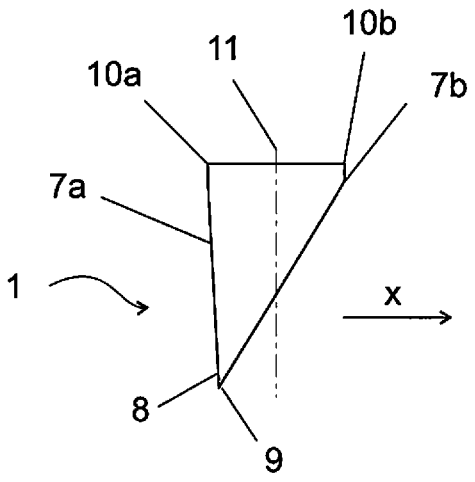
FIGS. 2*a-b* show a side view of a froth collection launder comprising a tip.
Figure 2B:
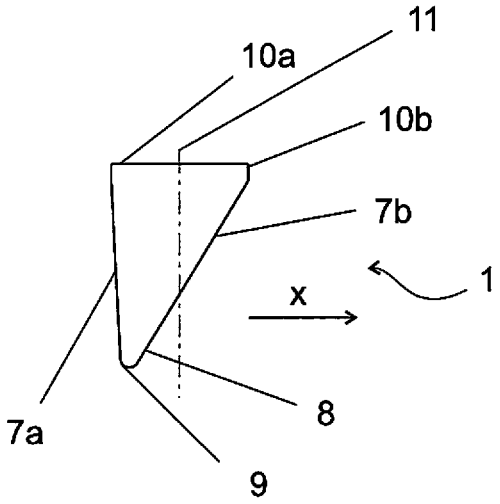

FIGS. 2*a-b* show a side view of a froth collection launder 1 comprising a tip. The froth collection launder 1 for a collection of froth 4 from a mineral flotation comprises a first 7*a* and a second 7*b* sidewall which are joined to form a bottom 8. The bottom 8 comprises a tip 9 extending along the bottom 8 in the direction of the length L of the launder 1. The first sidewall 7*a* comprises a first end 10*a* and the second sidewall 7*b* comprises a second end 10*b* at their open ends. In a froth collection launder 1 at least one of the first 10*a* and the second sidewall ends 10*b* comprises a froth overflow lip 5. When the froth collection launder 1 is positioned at its operation position an imaginary centre line 11 is equidistant from the first 10*a* and second sidewall ends 10*b* of the launder 1, i.e. an imaginary centre line is located in the middle of the first 10*a* and the second sidewall end 10*b* in the cross direction x of the launder 1. The tip 9 is located between the centre line 11 and one of the first 10*a* and the second sidewall end 10*b* in the cross direction x of the launder 1. The tip 9 forms the lowest point of the froth collection launder 1.

The tip 9 in the bottom 13 forms a froth flow 24 guide. The tip 9 is capable of dividing the froth flow 24 into a flow to the first sidewall 7*a* side of the launder 1 and into a flow to the second sidewall 7*b* side of the launder 1. The sidewalls 7*a-b* of the froth collection launder 1 guide the froth flows upwards.

Figure 4:
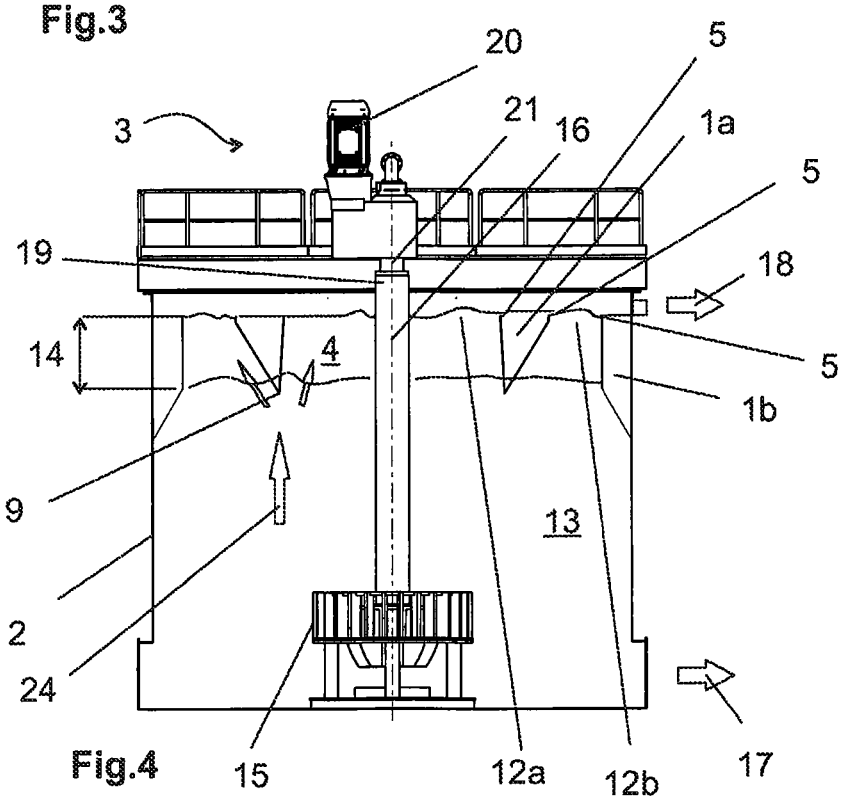
FIG. 4 shows an arrangement in a froth flotation cell comprising two launders.

The froth flow 24 comprises upwards flowing gas bubble-particle aggregates as shown in FIG. 4 with slim arrows. The unsymmetrically located tip 9 in the froth collection launder 1 balances froth 4 load to the froth collection launders 1. This allows more flexible designing of the froth flotation arrangement. As the froth collection lauder 1 effects the froth 4 flow direction the transport distance of the froth 4 can be optimized.

Further, the unsymmetrically located tip 9 in the froth collection launder 1 provides a stable concentrate grade. Further, the drop back of particles is reduced as the separate froth 4 areas on the top of the tank 2 are in balance and the recovery is increased. FIG. 1 presents two open areas 12*a-b* where the top surface of the froth layer 14 can be formed. One open area 12*a* is within the first froth collection launder 1 and another open area 12*b* is between the first 1 and second froth collection launders 1. The controlled distribution of the froth layer 14 among the open areas 12*a-b* prevents the slurry 13 located below the froth layer 14 to flow over the froth overflow lips 5 of the froth collection launders 1 which would decrease the concentrate grade.

The width w of the froth collection launder 1 is $0.3 \leq w < 1.5$ m, for instance. This width range of the froth collection launder 1 provides a better froth 4 handling as the lower surface of the froth collection launder 1 covers an optimal amount of area above the upwards flowing gas bubble-particle aggregates. A balanced gas bubble-particle aggregate flow causes a stable froth layer 14.

At the lower limit of the width range the lower surface of froth collection launder 1 is wide enough to cover a reasonable froth 4 area for the unsymmetrically positioned tip 9 to effect to the gas bubble-particle aggregate distribution. If the froth collection launder 1 is too narrow it does not cover enough froth 4 area for making a change to gas bubble-particle aggregate distribution.

At the upper limit of the width range the lower surface of froth collection launder 1 is narrow enough not to cover an excessive froth area so that the gas bubble-particle aggregates below the froth collection launder 1 are able to coalesce into larger bubbles. Large gas bubbles cause instability to the froth layer 14 possibly causing the slurry 13 to flow over the overflow lips 5 of the froth collection launders 1 which would decrease the concentrate grade.

Further, the height of the froth collection launder may comprise $0.5 \leq h < 2$ m, preferably $0.5 \leq h < 1.5$ m.

This height range of the froth collection launder 1 locates the tip 9 optimally in respect of the upwards flowing gas bubble-particle aggregates.

The tip 9 at the lowest point of the froth collection launder 1 is preferably in the slurry 13 layer. Then the created froth 4 in the froth layer 14 is not able to flow below the tip 9 in the horizontal direction. Further, the sidewalls 7*a-b* of the froth collection launder 1 guide the created froth 4 upwards.

At the upper limit of the height range the tip 9 of the froth collection launder 1 is in the layer where the created gas bubble-particle aggregates have been relatively constantly distributed. If the froth collection launder 1 is too high the tip 9 may reach a zone in the slurry 13 layer where the gas bubbles are strongly distributing in a horizontal direction.

Additionally, the ratio between the width w and the height h of the froth collection launder 1 can comprise w/h 0.2-0.9, preferably 0.3-0.7.

The froth collection launder 1 may comprise pieces which are connectable to form the froth collection launder 1, i.e. the froth collection launder 1 can be modular.

Preferably the periphery shape of the froth collection launder 1 corresponds the tank 2 periphery shape The shape of the froth collection launder 1 may be circular or rectangular, for instance.

The froth collection launder 1 may comprise two froth overflow lips 5 one at the first 10*a* and one at the second end 10*b*. This construction reduces the transport distance of the froth 4.

FIGS. 2*a-b* show a side view of a bottom 8 of a froth collection launder 1 comprising a tip 9.

FIGS. 3-6 show an arrangement in a froth flotation cell 3 for balancing froth 4 load to froth collection launders 1. The arrangement comprises a froth flotation cell 3 comprising a tank 2 comprising an impeller 15 within the tank 2 and a gas supply 16, and froth collection launders 1.

The tank 2 contains slurry 13 and the flotation cell 3 is capable of separating the slurry 13 into an underflow 17 and an overflow 18 as shown in FIG. 4. The slurry 13 is a mixture of solid particles in a carrier liquid, e.g. mineral particles in water. Froth flotation is a physical separation method for separating particles based on differences in the ability of air bubbles to selectively adhere to specific mineral surfaces in a mineral/water slurry. If a mixture of hydrophobic and hydrophilic particles are suspended in water, and air is bubbled through the suspension, then the hydrophobic particles will tend to attach to the air bubbles. The bubble-particle aggregates move up in the froth flotation cell 3 by buoyancy forming a froth layer 14 on the surface. The froth 4 comprises water, bubbles and particles.

Froth 4 is collected from the surface into a froth collection launder 1 located on the top of the cell tank 2. The froth flotation cell 3 can have one or more froth collection launders 1 which can be either internal or external or both, double, radial, depending on the capacity of the froth collection launder 1 necessary for the froth 4 removal. Large froth flotation tanks 2 comprising a volume 200 $m^3$ or more are often provided with at least two launders 1.

The tank 2 is mechanically agitated. The agitator 19 disperses air in the slurry 13, pumps slurry 13, keeps solids in the suspension and provides an environment in the cell tank 2 for interaction of bubbles and hydrophobic particles and their subsequent attachment and therefore separation of valuable mineral particles from the undesired gangue mineral particles. The agitator 19 comprises an impeller 15 and a drive assembly for rotating the impeller 15. The drive assembly may comprise a motor 20 and a drive shaft 21.

A gas supply 16 to the froth flotation cell 3 comprises pressurized or self-aspirating gas supply 16. Examples of pressurized gas supply systems are pipes or tubes delivering gas to the bottom part of the tank. Gas may be supplied to the impeller 15 area also through conduits formed to the agitator 19 comprising the impeller 15. The impeller 15 provides a uniform gas distribution.

Figure 3:
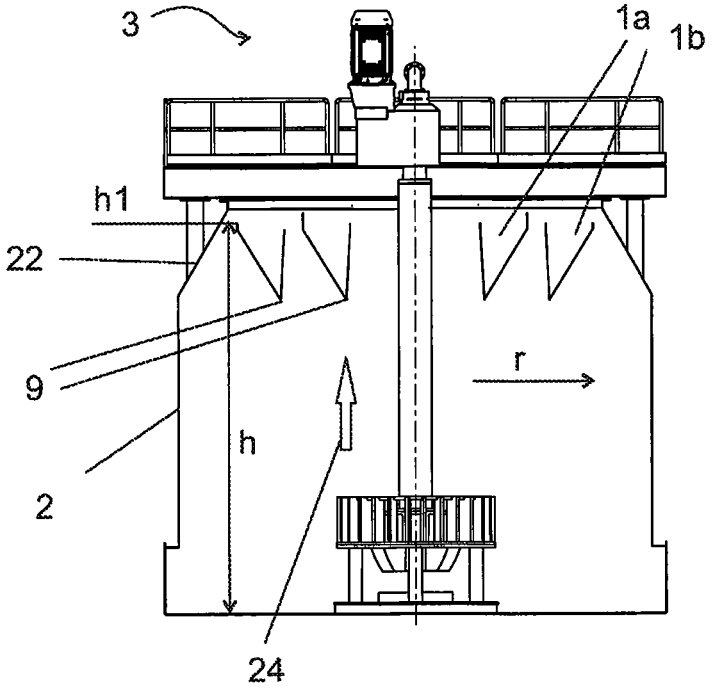
FIG. 3 shows an arrangement in a froth flotation cell comprising two launders.
Figure 5:
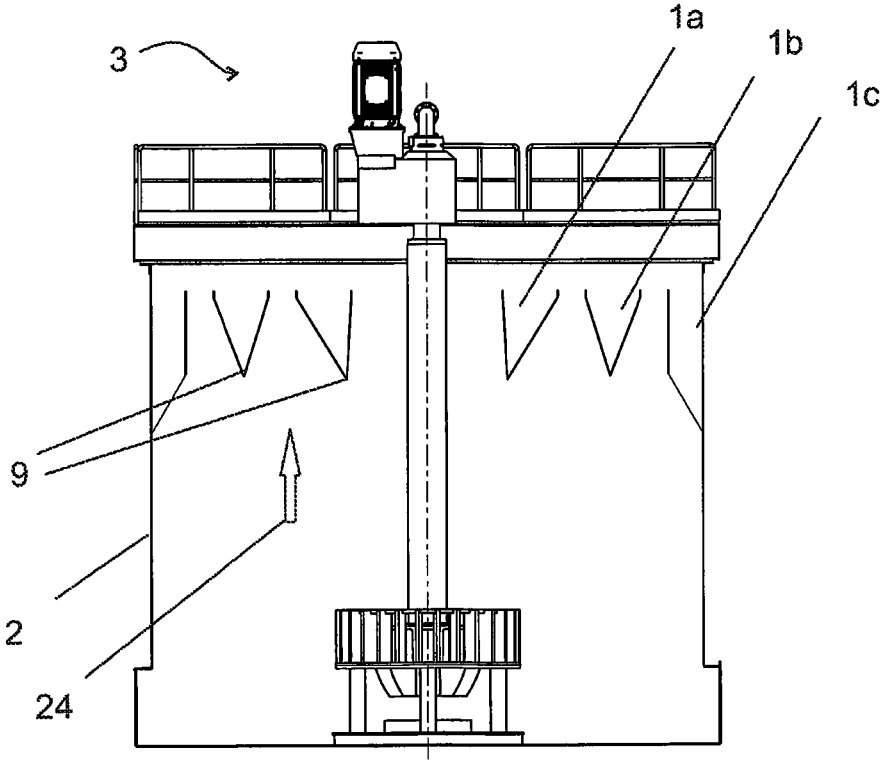
FIG. 5 shows an arrangement in a froth flotation cells comprising three launders.

In FIGS. 3-5 the impeller 15 is positioned in the slurry 13 layer at the bottom part of the tank 2 and it distributes gas bubbles. As shown in FIG. 4 the tip 9 of the froth collection launder 1 is positioned in the slurry 13 layer where the created gas bubble-particle aggregates have been relatively constantly distributed. If the tip 9 of the froth collection launder 1 is positioned in a slurry 13 layer close to the impeller 15 the tip 9 may disturb the distribution of the gas bubbles as the gas bubbles distribute in the tank 2 while flowing upwards.

The tank 2 volume may comprise at least 200 $m^3$. The tank 2 volume comprises the volume of the tank 2 surrounding the slurry 13 measured from the bottom of the tank 2 to height h1 of a froth overflow lip 5 of the froth collection launder 1. The large froth flotation cell 3 size poses challenges in regards of the froth flotation cell 3 operation, cell mixing and hydrodynamics, gas dispersion and froth transportation behaviour. Therefore in large froth flotation tanks 2 a strong agitation is necessary. The size of the impeller 15 does not increase with increasing froth flotation tank 2 size which means the gas bubbles continue dispersing in the slurry 13 layer longer. The froth load balancing with the unsymmetrical tip 9 performs well in strongly agitated froth flotation tanks 2.

The ratio between a height h from a bottom 13 of the tank 2 to the froth overflow lip 5 of the froth collection launder 1 and the diameter D of the tank 2 at the height of the impeller h/D is less than 1.5. With this ratio the tank 2 is relatively shallow with a large top surface for froth 4. The shallow tank 2 having a large top surface reduces the distance which the gas bubble-particle aggregates need to flow upwards. This reduces the risk of drop back of the gas bubble-particle aggregates during their flow towards the froth flotation launders 1.

Further, the arrangement shown in FIG. 3 comprises two froth collection launders 1, and the first launder 1 is arranged within the second launder 1 at a distance s apart. The froth collection launders 1 comprise circular peripheries and the bottoms 8 comprise tips 9.

In FIG. 3 the tips 9 are capable of dividing the froth flow 24 to a surface within the first launder 1*a*, to a surface between the first 1*a* and the second launder 1*b* and to a surface surrounding the second launder 1*b*. The froth collection launders comprise three overflow lips 5 which collect the froth 4 and conduct the froth 4 out of the tank 2. With the large froth flotation cell 3 sizes the introduction of multiple internal froth collection launders 1*a-b* forms multiple froth sub-areas between the launders 1*a-b*. The controlled distribution of the froth layer 14 among the sub-areas causing balanced load to the froth overflow lips 5 of the froth collection launders 1*a-b* result in an improved froth recovery.

The available froth surface area $A_{froth}$ is the horizontal area at the top of the tank 2 which is open for the froth 4 to flow at the height h1 of the froth overflow lip 5 of the froth collection launder 1. A flotation cell 3 with a large froth surface area could lead to a situation where insufficient material with solid particles is present to stabilize the froth 4. The available froth surface area $A_{froth}$ may then be reduced for creating a thicker froth layer 14. The reduction is made preferably at the periphery of the tank 2. The air bubbles distributed by an impeller 15 are not evenly distributed resulting in fewer air bubbles close to the tank 2 walls. Therefore the flow along the tank 2 walls can be guided without the risk of creating large air bubbles.

The reduction of the available froth surface area $A_{froth}$ can be implemented by means of an internal peripheral launder 15 or a tapered tank shape 22 at the tank 2 periphery, for instance. An internal peripheral froth collection launder 1 extends around the inside top of the sidewall of the tank 2 and is shown in FIGS. 4-7. As an example, the surface area of the internal peripheral launder 1 or the tapered tank shape 22 at the tank periphery comprises at least 10% of the pulp area $A_{pulp}$. The pulp area $A_{pulp}$ is calculated as an average from the cross sectional areas of the tank 2 at the height of the impeller 15.

In the arrangement of FIG. 3 the width of the first 1*a* and second froth collection launder 1*b* in the redial direction r is less than twice the width of the tapered tank shape 22 at the tank 2 periphery.

In an arrangement comprising two froth collection launders 1*a-b* where the first launder 1*a* is arranged within the second launder 1*b* at a distance s apart the bottoms 8 of the both froth collection launders 1 may comprise tips 9. The first sidewall 7*a* of the first launder 1*a* faces towards the second sidewall 7*b* of the second launder 1*b*. The tip 9 of the first launder 1*a* is located between the centre line 11 and the second end 10*b*. In the first launder 1*a* only the second end 10*b* of comprises a froth overflow lip 5. Thus the tip 9 of the first launder 1*a* guides the froth flow 24 more towards the froth overflow lip 5 than towards the second end 10*b* of the second sidewall 7*b* of the second launder 1*b*.

FIG. 4 shows an arrangement in a froth flotation cell 3. In FIG. 4 the two froth collection launders 1*a-b* comprise three froth overflow lips 5. The radially outer froth collection launder 1*b* is an internal peripheral launder which surrounds the periphery of the tank 2. The inner froth collection launder 1*a* comprises a tip 9 forming a froth flow 24 guide. The froth collection launders 1*a-b* are arranged to distribute froth to an open area 12*a* within the first launder and to an open area 12*b* between the first and the second launder. The controlled distribution of the froth layer 14 among the open areas 12*a-b* causing balanced load to the froth overflow lips 5 of the froth collection launders 1*a-b* result in an improved concentrate grade.

FIG. 5 shows an arrangement in a froth flotation cell 3. In FIG. 5 shown arrangement the tank 2 comprises three froth collection launders 1*a-c* wherein two inner froth collection launders 1*a-b* comprise tips 9. The froth transport distance between the first froth collection launder 1*a* and the second froth collection launder 1*b* is equal to the froth transport distance between the second froth collection launder 1*b* and the third froth collection launder 1*c*. The froth transport distance is the average distance the froth has to travel in horizontal direction before reaching the froth overflow lip 5.

The arrangement in a froth flotation cell 3 can be used for balancing froth load to the froth collection launders 1*a-c*.

Figure 6:
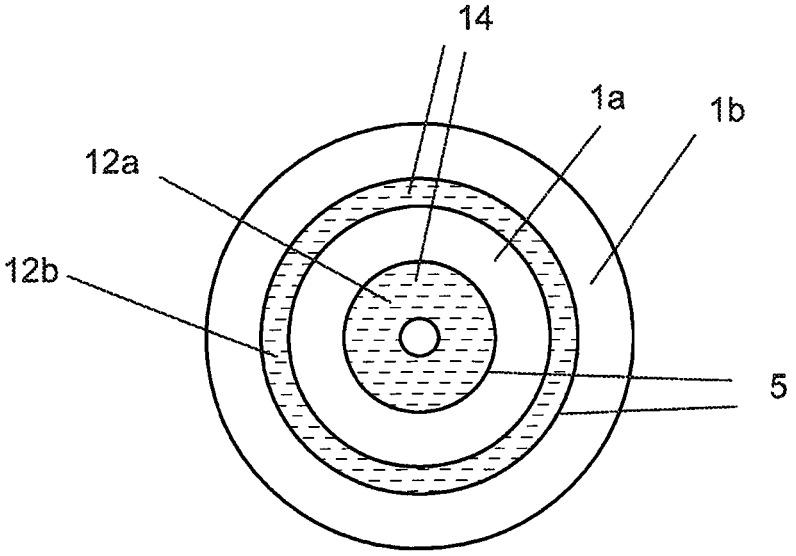
FIG. 6 shows a top view of an arrangement in a froth flotation cell comprising two launders.

FIG. 6 shows a top view of an arrangement in a froth flotation cell 3 with two froth collection launders 1*a-b*. The arrangement comprises two froth overflow lips 5 which define two separate open areas 12*a-b* in the horizontal direction. The open areas 12*a-b* are for the froth 4 to flow. The top surface of a froth layer 14 is shown with hatching in the open areas 12*a-b*. By separate open areas 12*a-b* is referred to areas where the possible opening between areas is so small that it does not allow balancing of the froth layer 14 between the open areas 12*a-b*.

Figure 7:
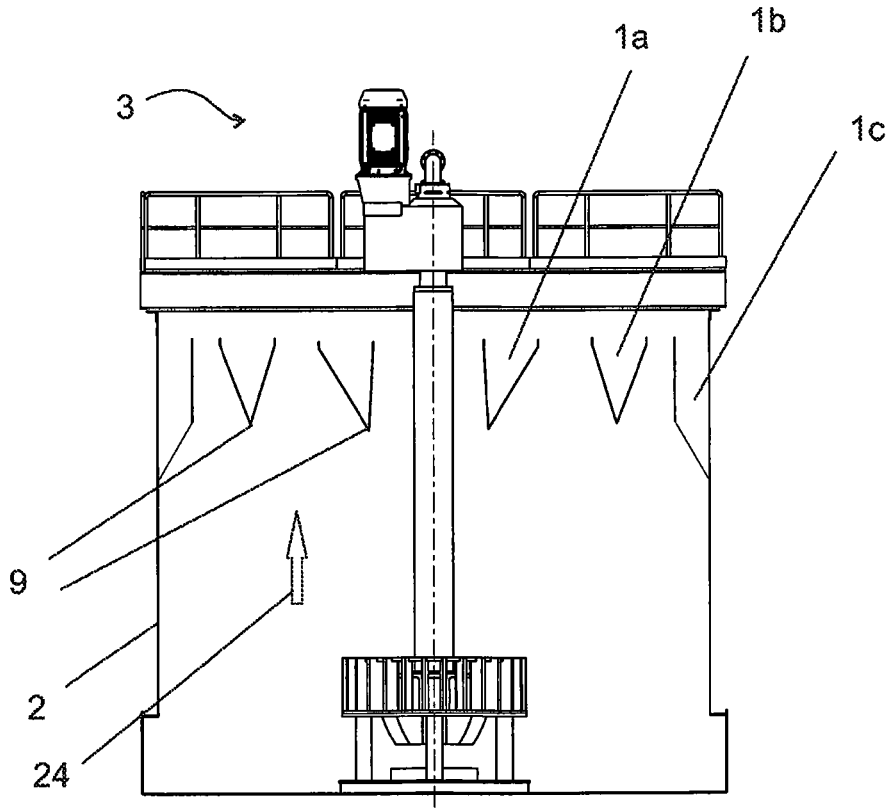
FIG. 7 shows an arrangement in a froth flotation cells comprising three launders.

FIG. 7 shows an arrangement in a froth flotation cell 3 comprising three froth collection launders 1*a-c*. The tank comprises three froth collection launders 1*a-c*, and a froth transport distance between the first 1*a* and the second launder 1*b* is 80%-120% of the froth transport distance between the second 1*b* and the third launder 1*c*. The shown froth collection launders 1*a-c* are circular shaped and arranged coaxially. The first froth collection launder 1*a* is the innermost, the third froth collection launder 1*c* is the outermost and the second froth collection launder 1*b* is located between the first 1*a* and third 1*c* froth collection launders. The first and second froth collection launders 1*a-b* comprise tips 9.

As shown in the Figures it is not necessary that all the froth collection launder 1*a-c* bottoms 8 comprise tips 9 in a froth flotation cell 3. The arrangement in a froth flotation cell 3 may comprise a multiple of froth collection launders 1*a-c* wherein at least one froth collection launder 1*a-c* comprises a tip 9 in the bottom 13 forming a froth flow 24 guide.

Figure 8:
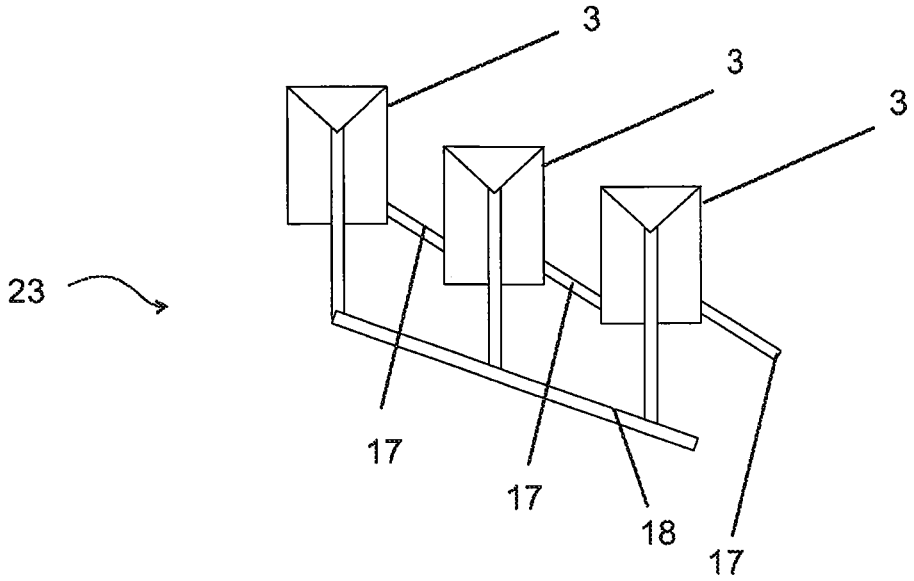
FIG. 8 shows a primary line in an arrangement in a froth flotation cell.

FIG. 8 shows a primary line 23 in an arrangement in a froth flotation cell 3. The flotation cell 3 is capable of separating the slurry 13 into an underflow 17 and an overflow 18. A primary line 23 comprises at least three flotation cells 3 connected in series, wherein each subsequent flotation cell 3 is arranged to receive the underflow 17 from the previous flotation cell 3, and the third froth flotation cell 3 or subsequent froth flotation cell 3 in the series comprises the tip 9 located between the centre line 11 and one of the first 10*a* and the second end 10*b* in the cross direction x of the froth collection launder 3 and the tip 9 forms the lowest point of the froth collection launder 3.

The amount of valuable mineral in the slurry 13 reduces after each subsequent flotation cell 3. Therefore the thickness of the froth layer 14 above the slurry 13 decreases. Then the froth balance between the froth surface areas becomes more important that the required grade level can be achieved.

The presented arrangement and method are suitable for a slurry 13 comprising copper (Cu), for instance. The slurry 13 fed to the third froth flotation cell or subsequent froth flotation cell in the series may comprise copper (Cu) less than 0.2 weight %.

It will be obvious to a person skilled in the art that, as the technology advances, the inventive concept can be implemented in various ways. The invention and its embodiments are not limited to the examples described above but may vary within the scope of the claims.

Part list: 1,1*a-c* a froth collection launder; 2 a tank; 3 a froth flotation cell; 4 froth; 5 a froth overflow lip; 6 a discharge pipe; 7*a* a first sidewall, 7*b* a second sidewall; 8 a bottom; 9 a tip; 10*a* a first sidewall end, 10*b* a second sidewall end; 11 a centre line; 12*a-b* an open area; 13 slurry; 14 a froth layer; 15 an impeller; 16 a gas supply; 17 an underflow; 18 an overflow; 19 an agitator; 20 a motor; 21 a drive shaft; 22 a tapered tank shape; 23 a primary line, 24 a froth flow.

A froth an available froth surface area; $A_{pulp}$ a pulp area; D a diameter; s a distance; h a height; h1 a height; L a length direction; r radial direction; x a cross direction; w a width.

The invention claimed is:

1. A froth collection launder for a collection of froth from a mineral flotation, the froth collection launder comprising an inner and outer sidewall which are joined to form a bottom comprising a tip extending along the bottom, the inner sidewall comprising a first end and the outer sidewall comprising a second end at their open ends, at least one of the first and the second ends comprises a froth overflow lip, and when the froth collection launder is positioned at its operation position a centre line is located in the middle of the inner and outer sidewalls in a radial direction of the froth collection launder, wherein the tip is located between the centre line and one of the inner and outer sidewalls in the radial direction of the froth collection launder and the tip forms the lowest point of the froth collection launder.

2. The froth collection launder according to claim 1, wherein the width (w) of the froth collection launder is $0.3 \leq W < 1.5$m.

3. The froth collection launder according to claim 1, wherein the height (h) of the froth collection launder is $0.5 \leq h < 2$m, preferably $0.5 \leq h < 1.5$m.

4. The froth collection launder according to claim 1, wherein the ratio between the width and the height of the launder w/h is 0.2-0.9, preferably 0.3-0.7.

5. The froth collection launder according to claim 1, wherein the first and the second end comprise the froth overflow lip.

6. The froth collection launder according claim 1, wherein the froth collection launder comprises pieces which are connectable to form the froth collection launder and the periphery shape of the froth collection launder corresponds to a tank periphery shape.

7. The arrangement in a froth flotation cell for balancing froth load to froth collection launders, the arrangement comprising a froth flotation cell, the froth flotation cell comprising a tank comprising an impeller within the tank and a gas supply, the flotation cell being capable of separating slurry into an underflow and an overflow, and the arrangement comprising a first froth collection launder according to claim 1.

8. The arrangement in a froth flotation cell according to claim 7, wherein the tank volume comprises at least 200 m3.

9. The arrangement in a froth flotation cell according to claim 7, wherein a ratio between a height (h) from a bottom of the tank to the froth overflow lip of the froth collection launder and the diameter (D) of the tank at the height of the impeller (h/D) is less than 1.5.

10. The arrangement in a froth flotation cell according to claim 7, wherein the arrangement comprises two froth overflow lips which define two separate open areas in the radial direction for the top surface of a froth layer.

11. The arrangement in a froth flotation cell according to claim 7, wherein the arrangement comprises two froth collection launders, and the first froth collection launder is arranged within a second froth collection launder at a distance(s) apart.

12. The arrangement in a froth flotation cell according to claim 11, wherein the froth collection launders comprise three overflow lips, and the froth collection launders are arranged to distribute froth to an open area surface within the first froth collection launder and to an open area between the first and the second froth collection launder.

13. The arrangement in a froth flotation cell according to claim 11, wherein the tank comprises either an internal peripheral launder or a tapered tank shape at the tank periphery, and the surface area of the internal peripheral launder or the tapered tank shape at the tank periphery comprises at least 10% of a pulp area (A pulp).

14. The arrangement in a froth flotation cell according to claim 13, wherein the width (w) of the first froth collection launder and the second froth collection launder is less than twice the width of the internal peripheral launder or the width of the tapered tank shape at the tank periphery.

15. The arrangement in a froth flotation cell according to claim 7, wherein the first froth collection launder comprises a circular periphery.

16. The arrangement in a froth flotation cell according to claim 7, wherein the tank comprises three froth collection launders, and a froth transport distance between the first froth collection launder and a second froth collection launder is 80%-120% of the froth transport distance between the second froth collection launder and a third froth collection launder.

17. The arrangement in a froth flotation cell according to claim 7, wherein the tank comprises three froth collection launders, and a froth transport distance between the first froth collection launder and a second froth collection launder is equal to the froth transport distance between the second froth collection launder and a third froth collection launder.

18. The arrangement in a froth flotation cell according to claim 7, wherein the gas supply comprises a pipe delivering gas to the bottom part of the tank or to a conduit formed to an agitator comprising the impeller.

19. The arrangement in a froth flotation cell according to claim 7, wherein the gas supply comprises a conduit formed to an agitator comprising the impeller.

20. The arrangement in a froth flotation cell according to claim 7, wherein the arrangement comprises a primary line comprising at least three flotation cells connected in series, wherein each subsequent flotation cell is arranged to receive the underflow from the previous flotation cell, and a third flotation cell or a subsequent flotation cell in the series comprises a froth collection launder according to claim 1.

* * * * *